US009222308B2

(12) United States Patent
Zeineddine et al.

(10) Patent No.: US 9,222,308 B2
(45) Date of Patent: Dec. 29, 2015

(54) DETECTING STICK-SLIP USING A GYRO WHILE DRILLING

(75) Inventors: Firas Zeineddine, Bristol (GB); Maja Ignova, Cheltenham (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 610 days.

(21) Appl. No.: 13/530,016

(22) Filed: Jun. 21, 2012

(65) Prior Publication Data

US 2013/0341090 A1 Dec. 26, 2013

(51) Int. Cl.
*E21B 7/00* (2006.01)
*E21B 44/00* (2006.01)

(52) U.S. Cl.
CPC . *E21B 7/00* (2013.01); *E21B 44/00* (2013.01); *E21B 44/005* (2013.01)

(58) Field of Classification Search
CPC ..... E21B 7/00; E21B 44/00; E21B 44/005
See application file for complete search history.

(56) References Cited

U.S. PATENT DOCUMENTS

| | | | | |
|---|---|---|---|---|
| 4,696,112 | A * | 9/1987 | Hoffman | 33/304 |
| 2005/0087367 | A1* | 4/2005 | Hutchinson | 175/45 |
| 2005/0150692 | A1* | 7/2005 | Ballantyne et al. | 175/61 |
| 2010/0082256 | A1* | 4/2010 | Mauldin et al. | 702/9 |
| 2010/0223796 | A1* | 9/2010 | Imamura et al. | 33/321 |
| 2011/0147083 | A1* | 6/2011 | Mauldin et al. | 175/50 |
| 2012/0123757 | A1* | 5/2012 | Ertas et al. | 703/2 |
| 2012/0222900 | A1* | 9/2012 | Rodney et al. | 175/56 |
| 2013/0025851 | A1* | 1/2013 | Laing et al. | 166/250.01 |
| 2013/0049981 | A1* | 2/2013 | MacPherson et al. | 340/853.1 |
| 2013/0092439 | A1* | 4/2013 | Mauldin et al. | 175/40 |
| 2013/0220600 | A1* | 8/2013 | Barki et al. | 166/250.01 |

* cited by examiner

*Primary Examiner* — Nicole Coy
(74) *Attorney, Agent, or Firm* — Chadwick A. Sullivan; Wesley Noah

(57) ABSTRACT

A method for drilling operation in a subterranean formation, including calculating, by a hardware processor and in response to determining that an magnitude of gyro data representing rotations of a drill bit in a bottom hole assembly (BHA) and a time derivative of the gyro data are within a pre-determined range, a drift parameter of the gyro data, analyzing, by the hardware processor, the gyro data based on the drift parameter to generate a stick-slip alert, and presenting the stick-slip alert.

20 Claims, 12 Drawing Sheets

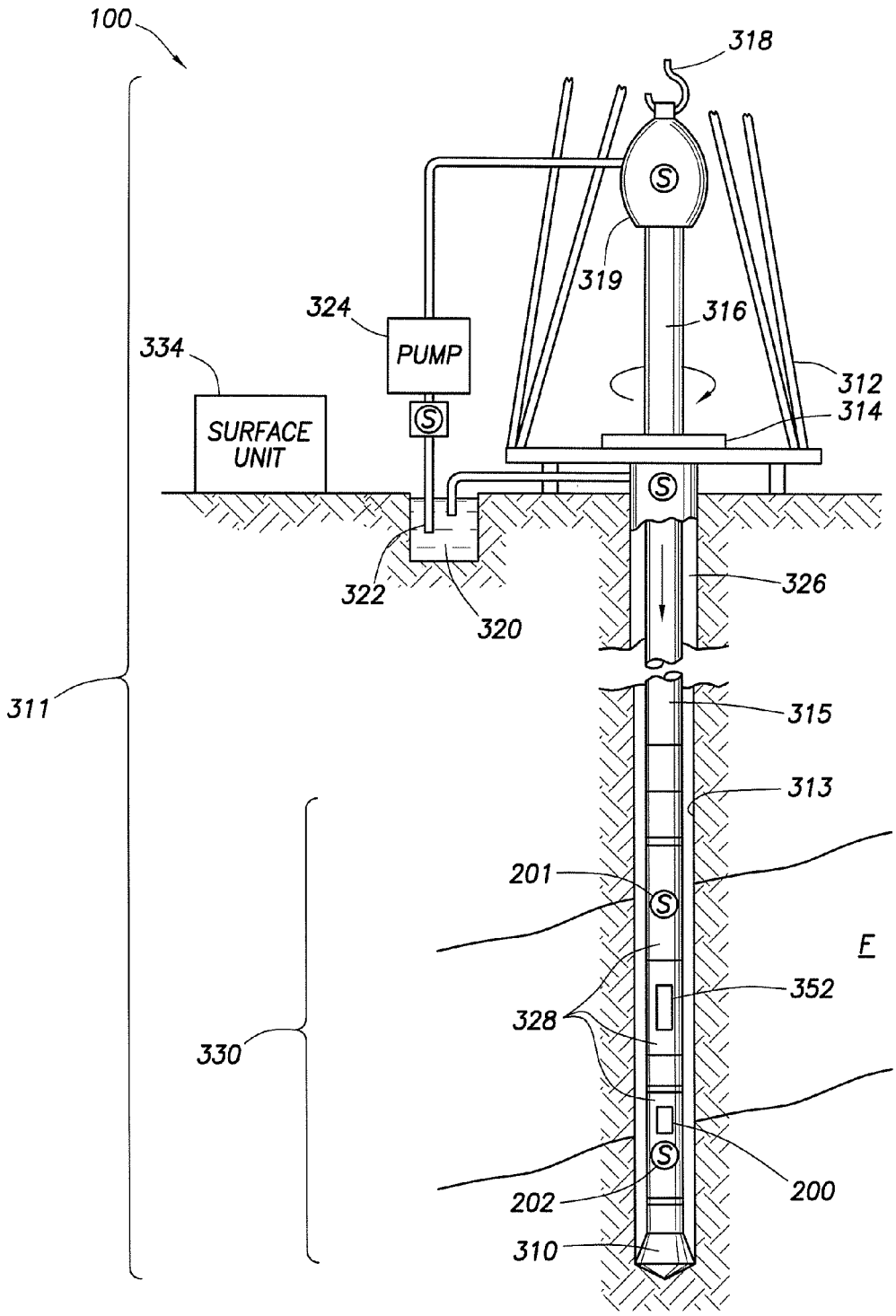
FIG. 1.1

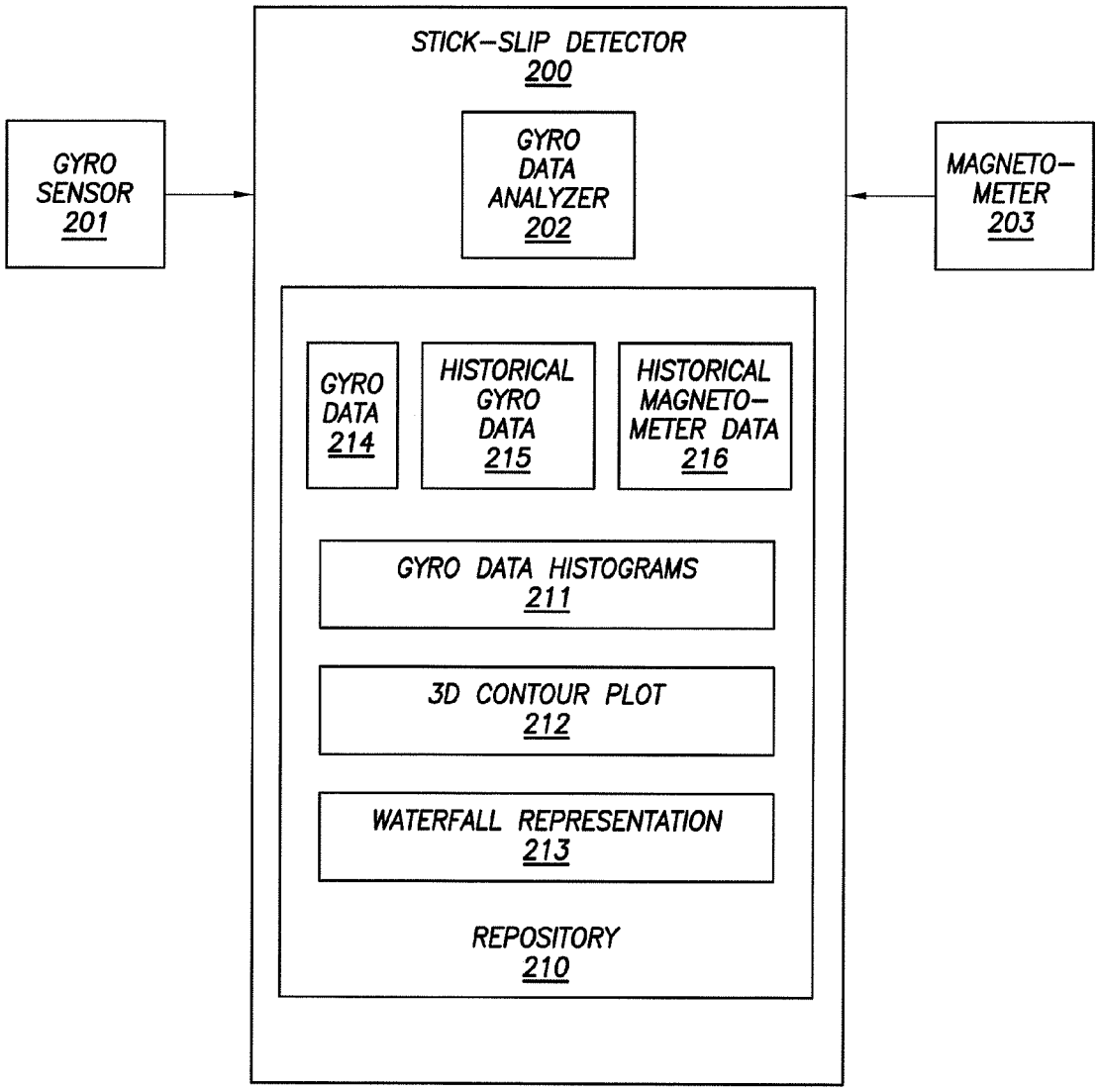
FIG. 1.2

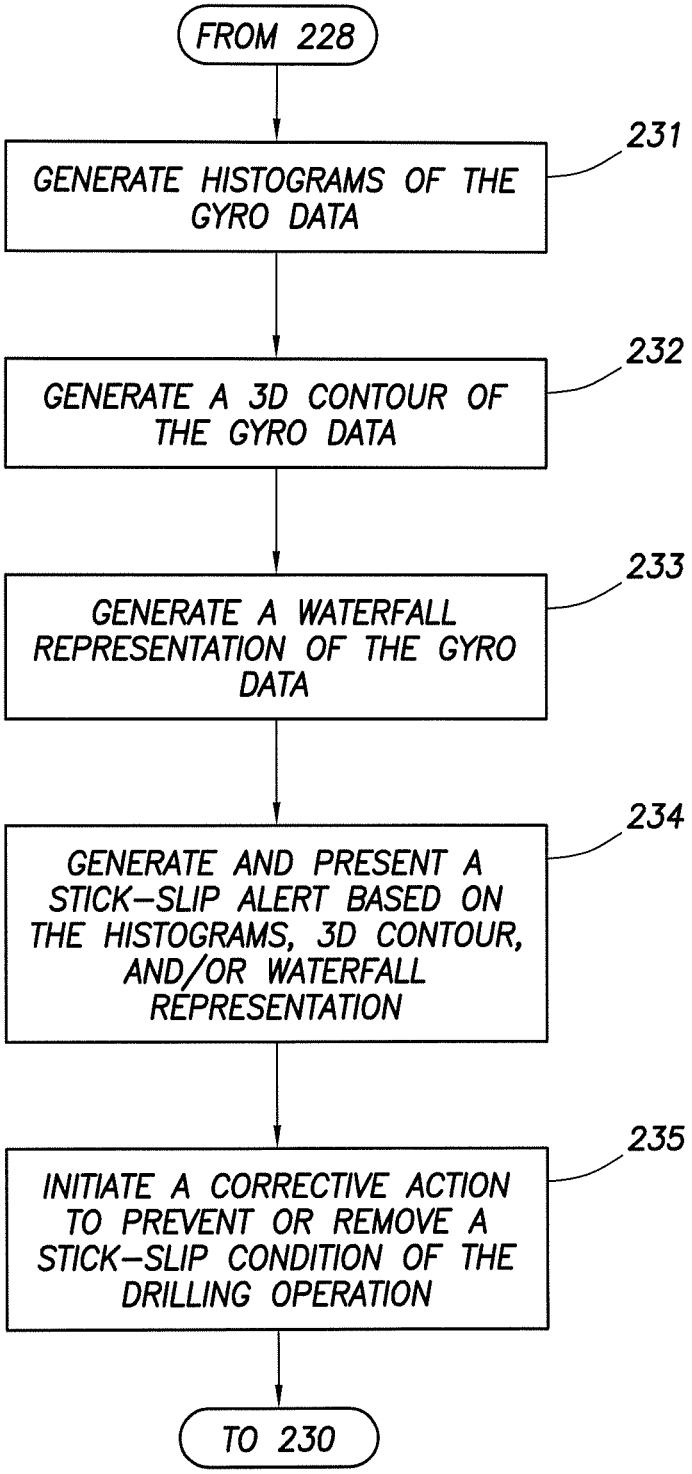
FIG.2.1

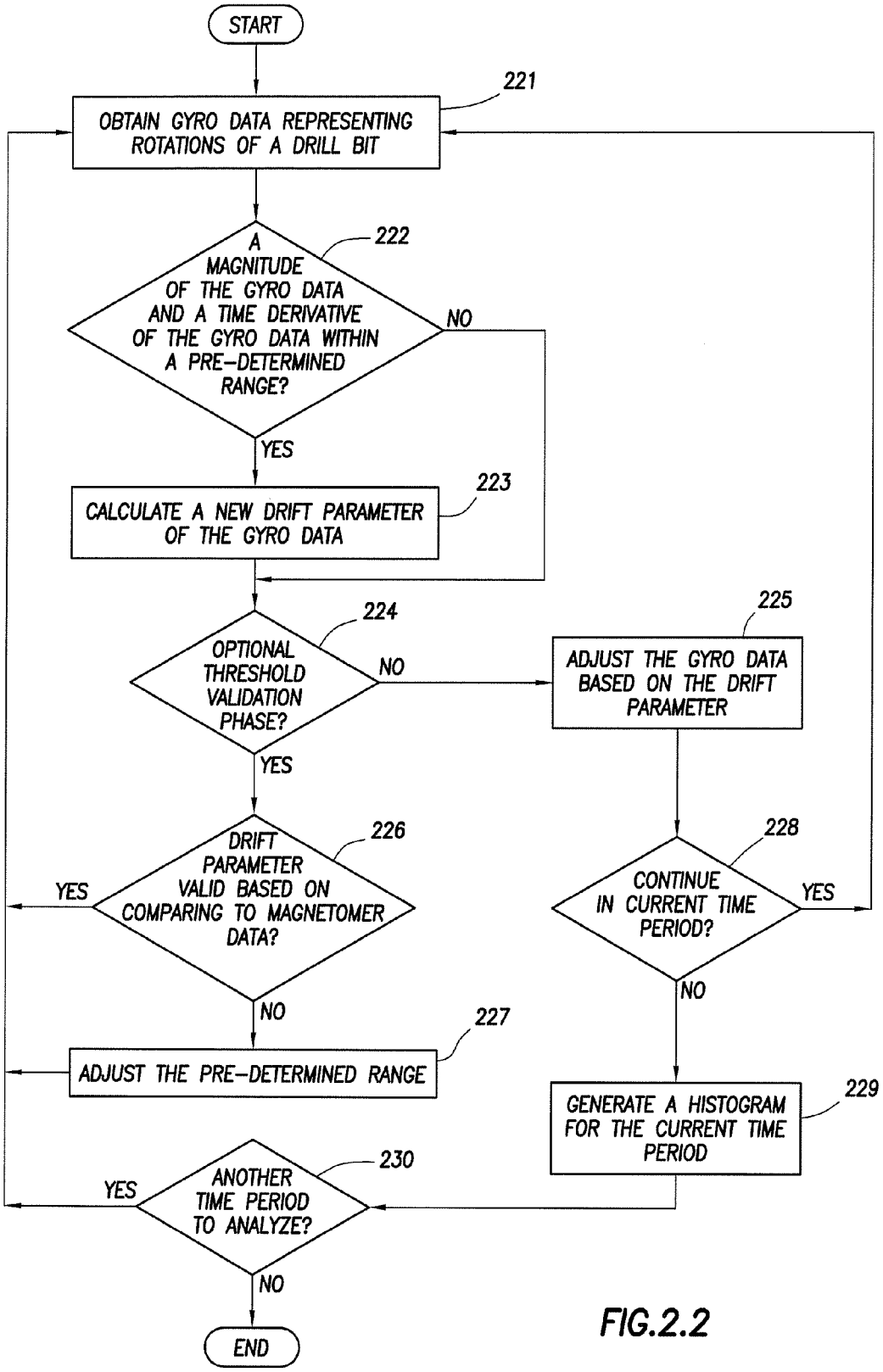
FIG.2.2

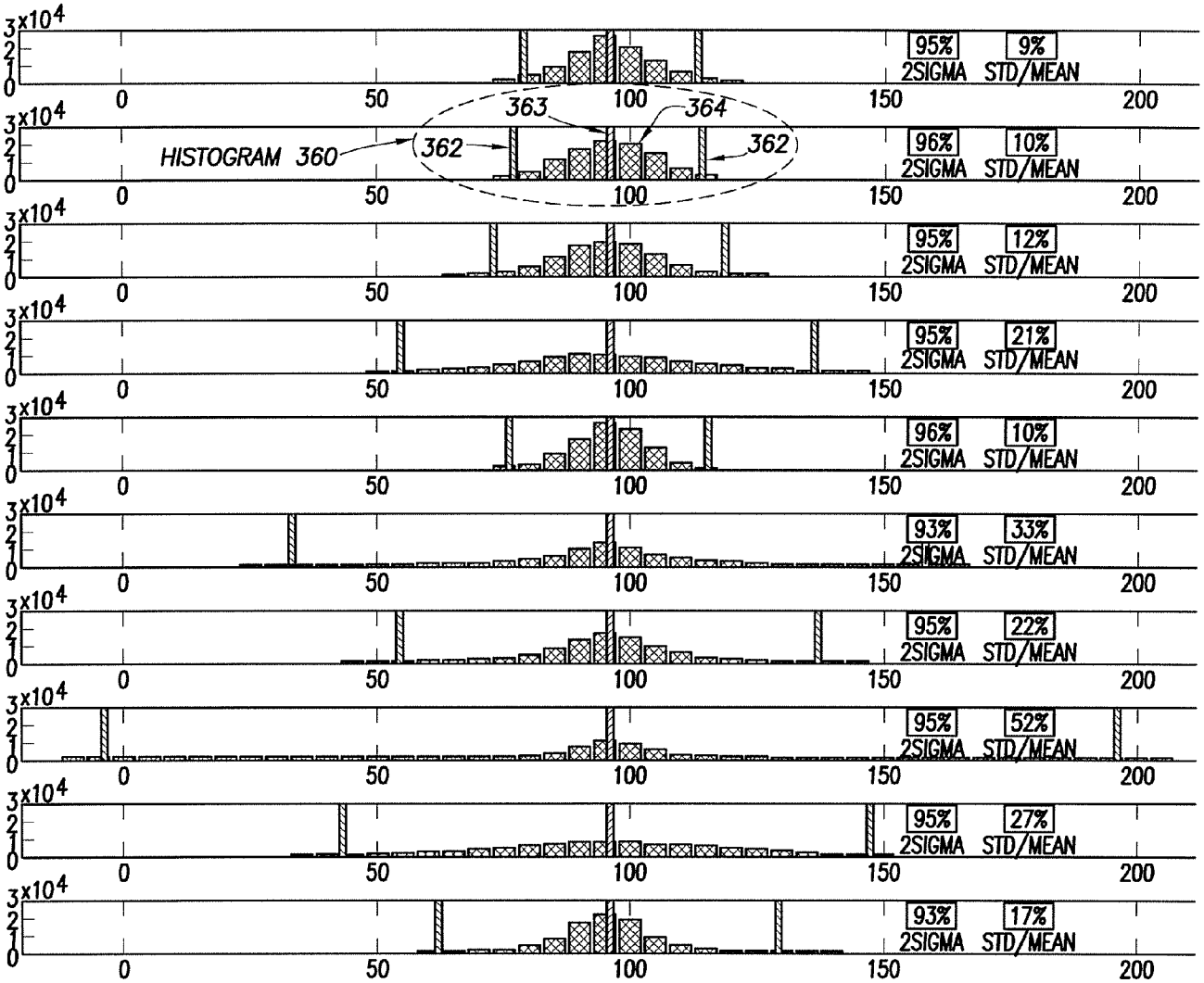
FIG.3.1

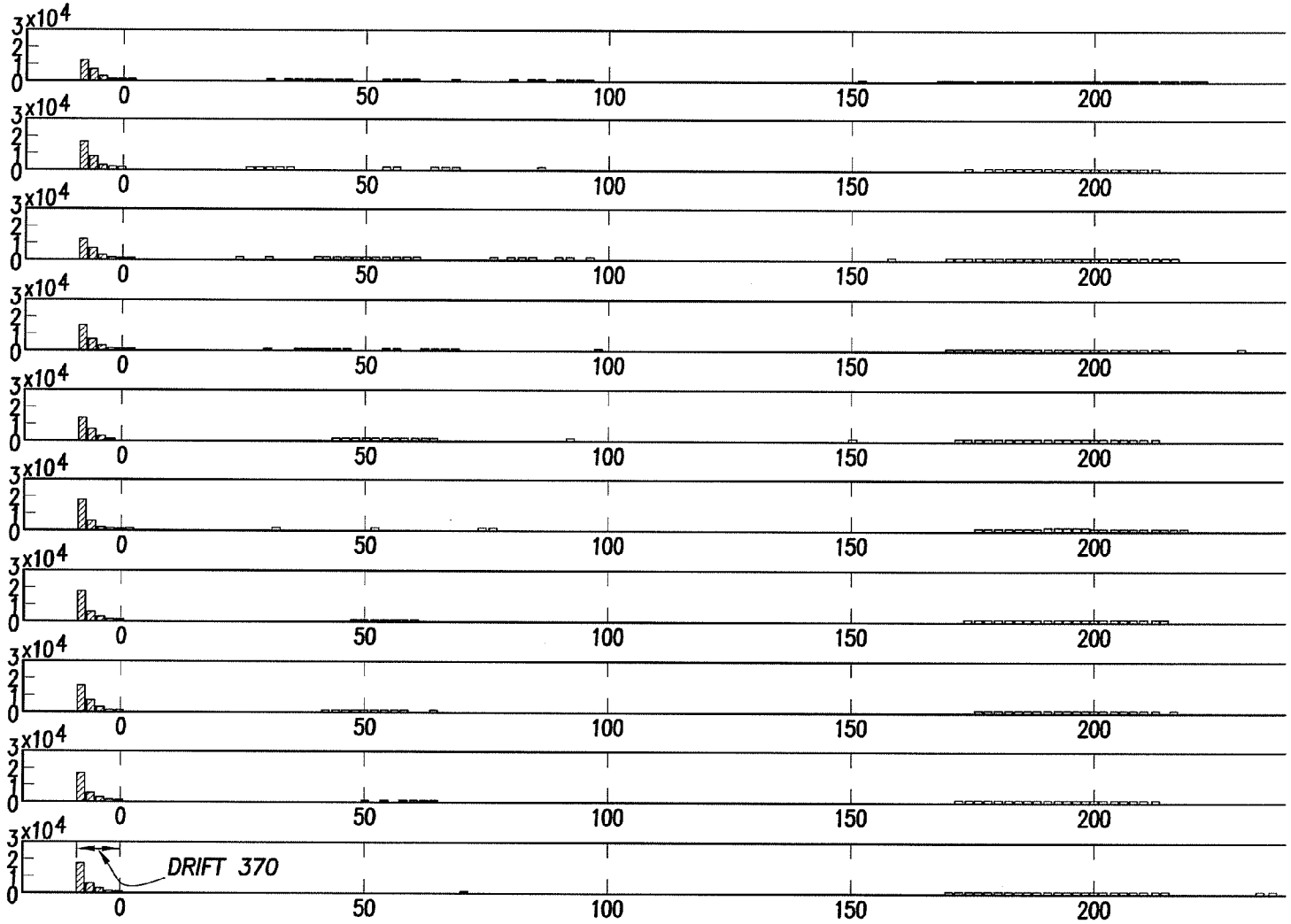
FIG.3.2

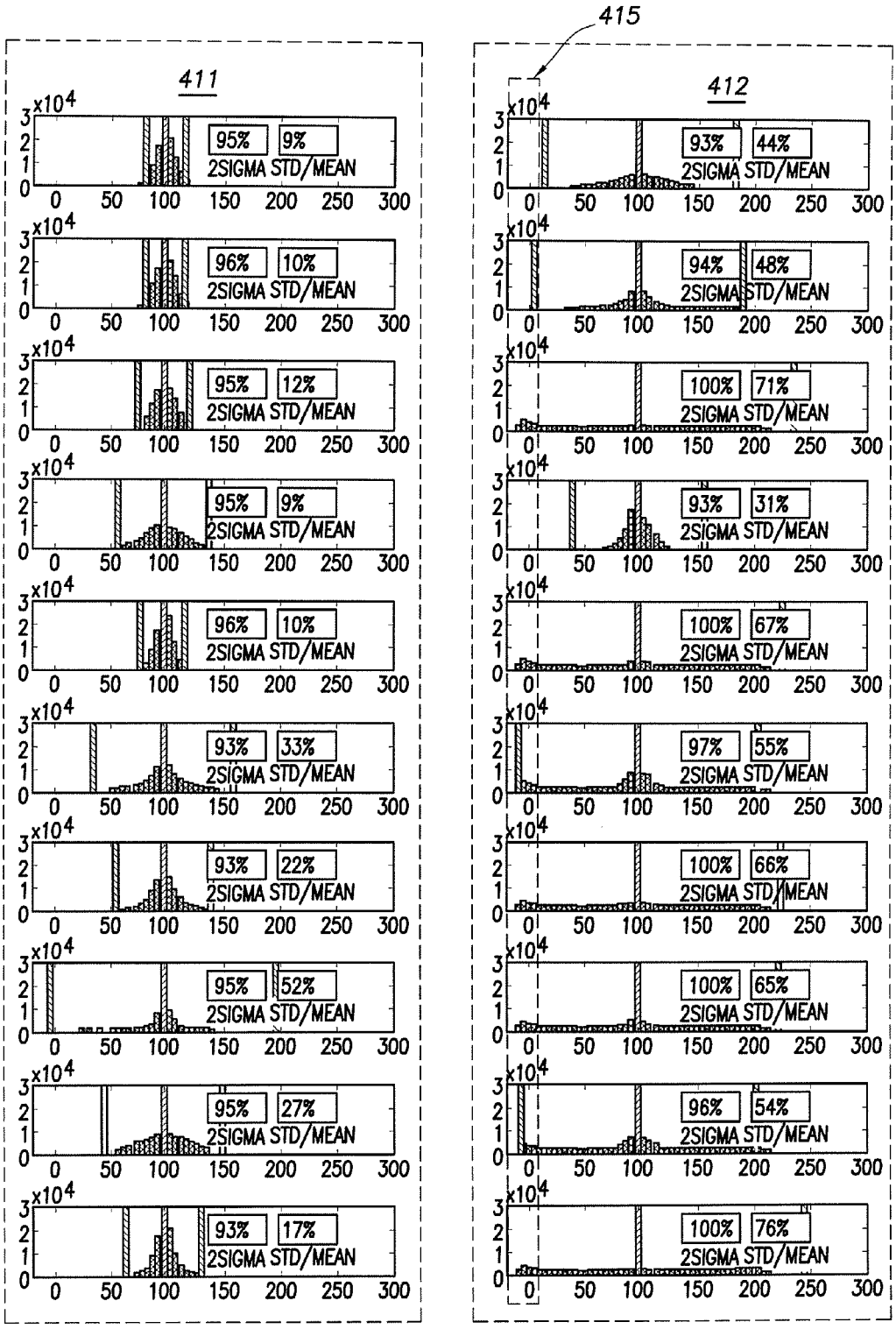
FIG. 4.1

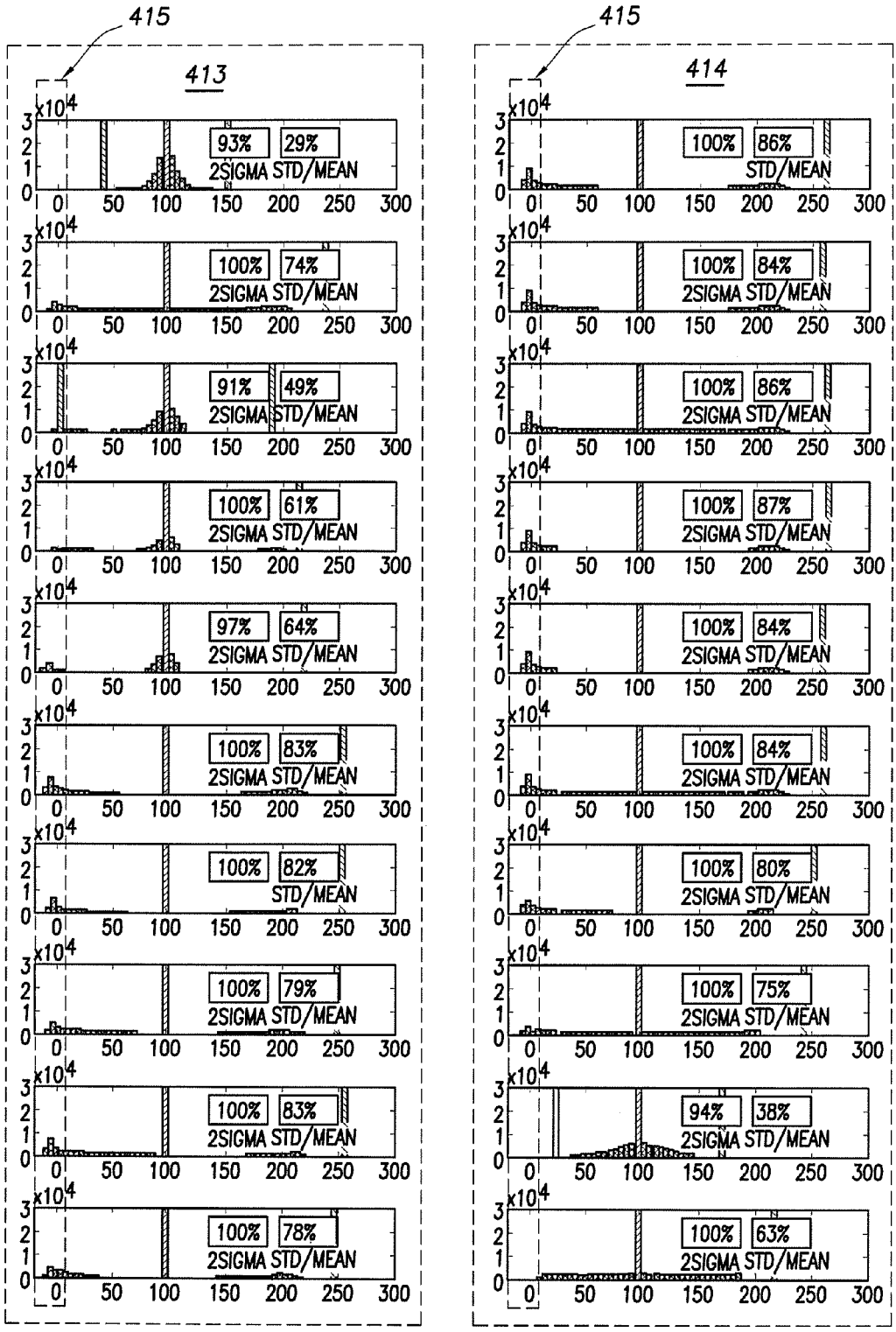
FIG.4.2

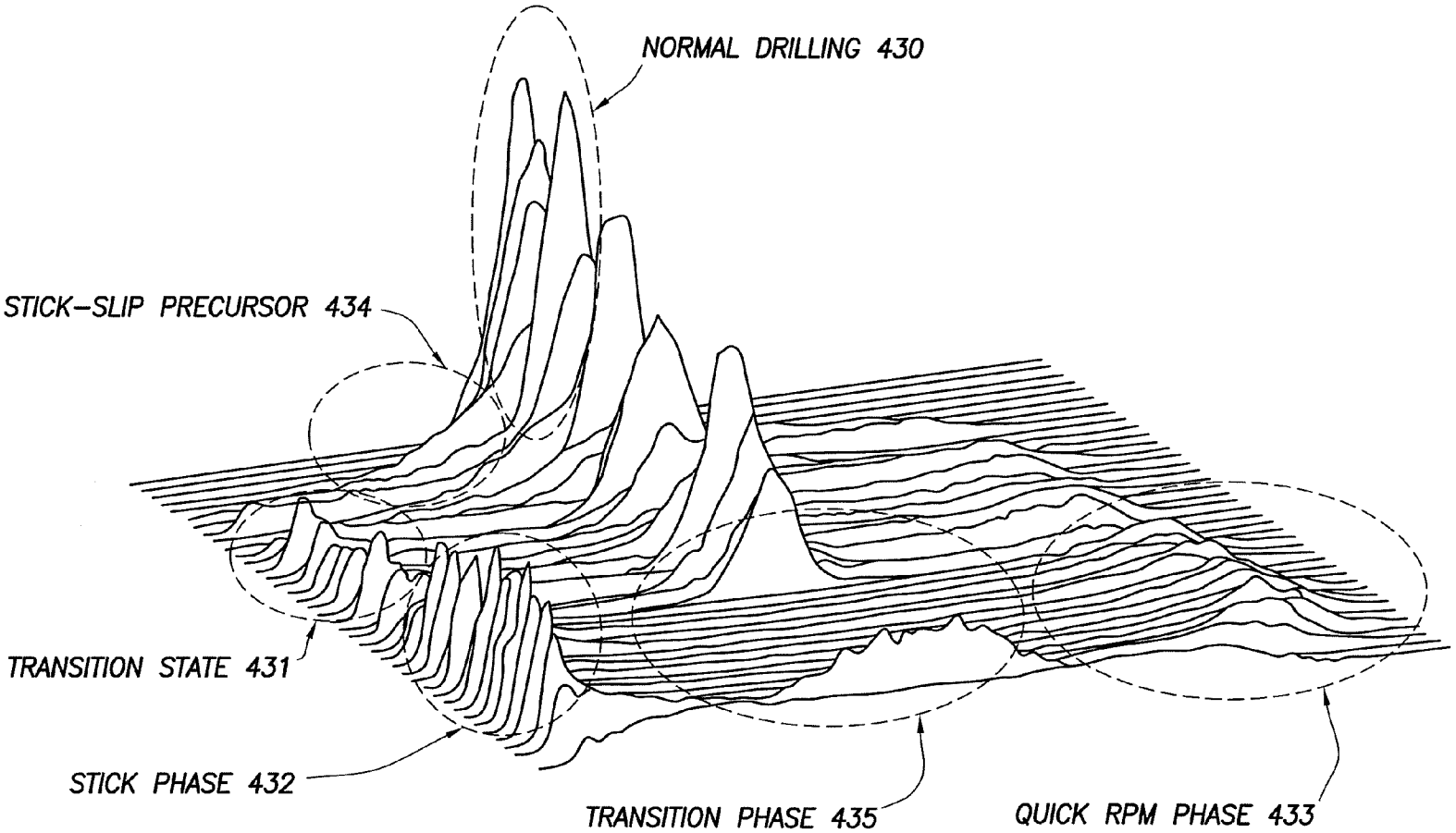
FIG. 4.3

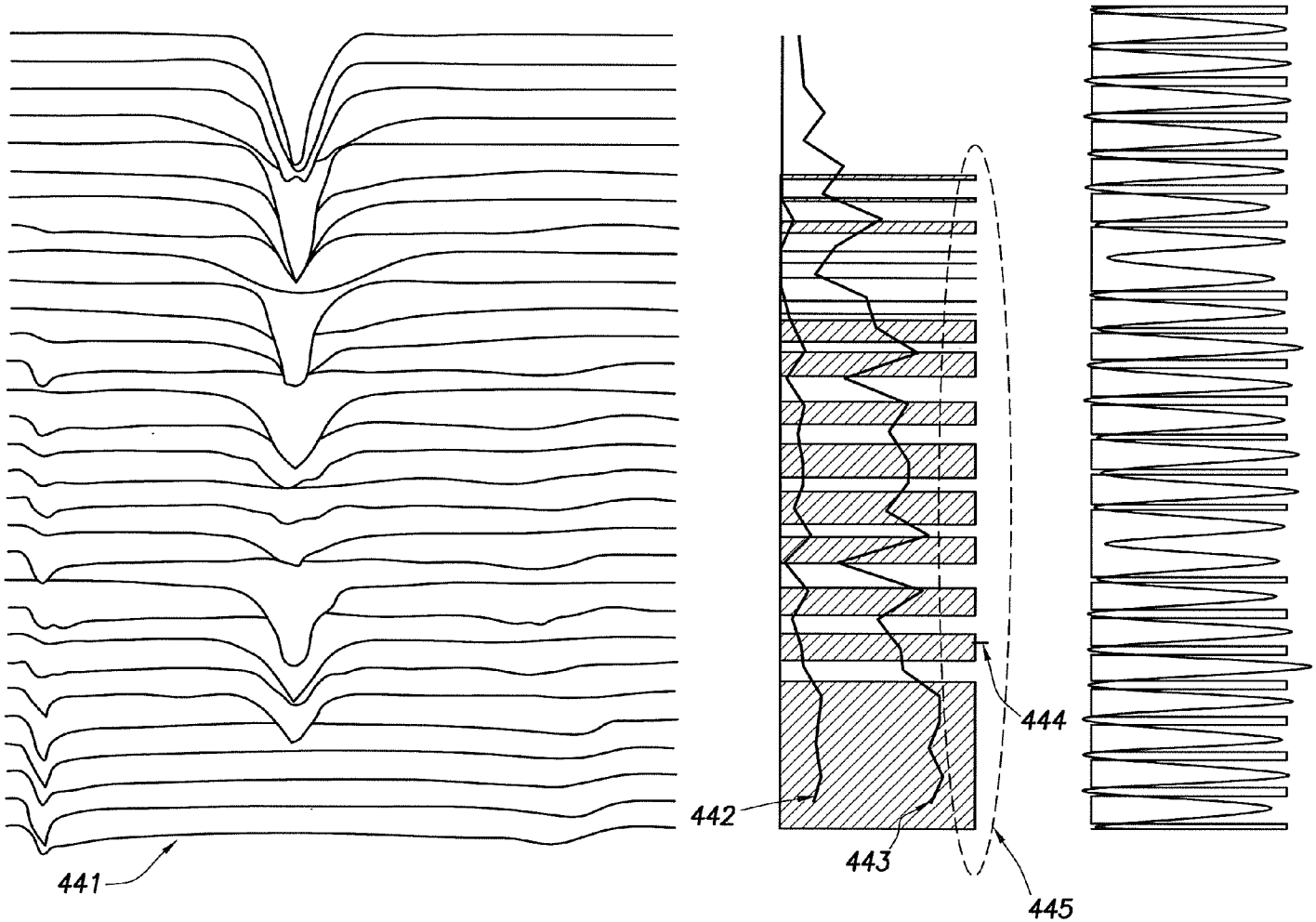
FIG. 4.4

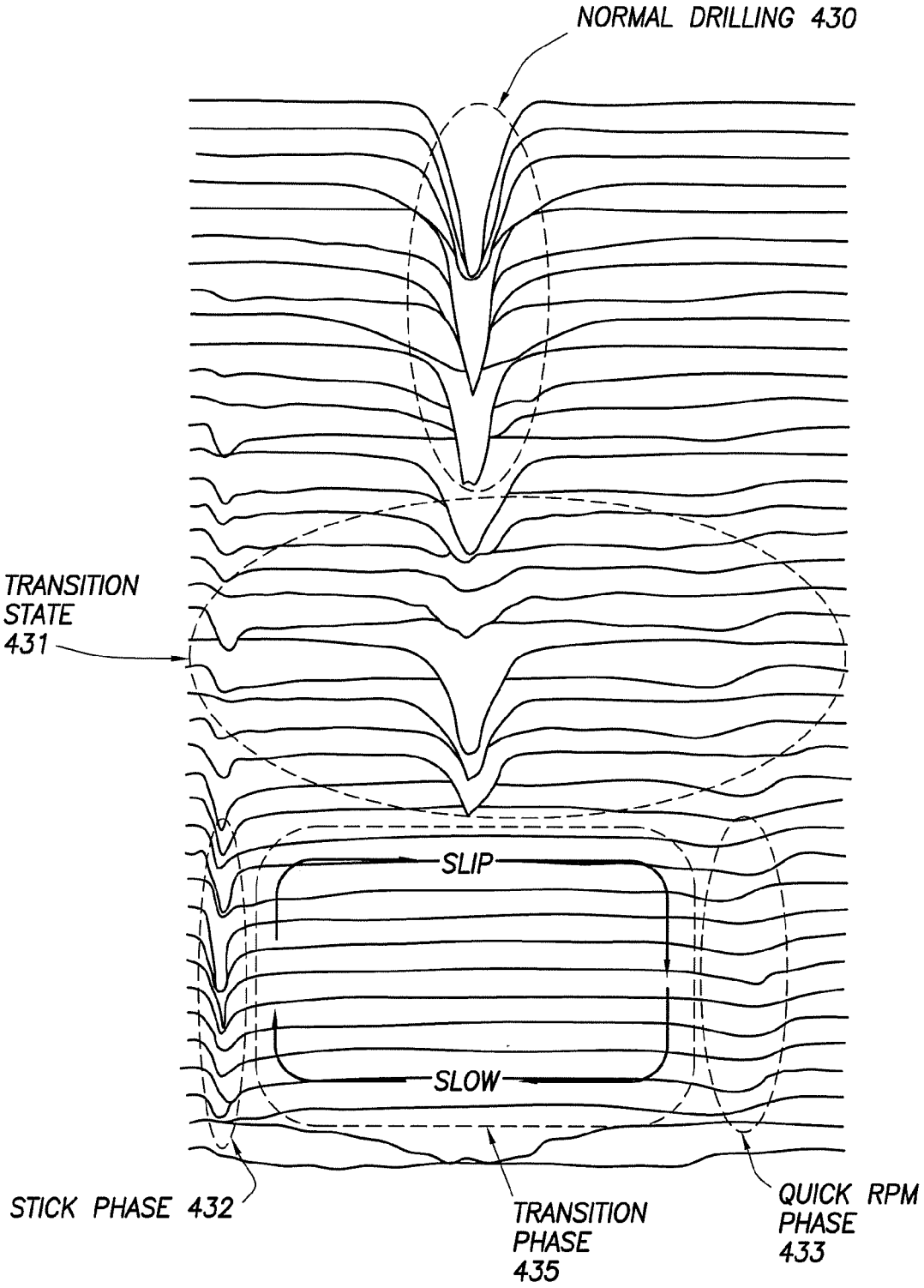
FIG. 4.5

DETECTING STICK-SLIP USING A GYRO WHILE DRILLING

BACKGROUND

Oil drilling is a general term for any boring through the Earth's surface that is designed to find and acquire underground asset such as hydrocarbons. A drillstring on a drilling rig is a column, or string, of drill pipe that transmits drilling fluid and torque to the drill bit. While drilling, the drillstring can experience different shock and vibration modes. Stick-slip is an undesired drilling state that occurs when the drillstring cannot sustain a constant rotation under the given drilling parameters. The borehole assembly (BHA) eventually reaches a complete stop, denoted as the stick phase, and then the continuing constant rotation from the surface boosts the torque to a critical value which causes a sudden release of the BHA, denoted as the slip phase. The slip phase is characterized by enormous speeds of rotation and rotational accelerations. Stick-slip can reduce directional performance of the BHA, impact measurement quality, and increase rates of component failure due to fatigue. Drillstring stick-slip is one of the most destructive downhole events and can damage tools and cause catastrophic failures leading to loss of the well or loss of rig time.

SUMMARY

In general, in one aspect, the invention relates to a method for drilling operation in a subterranean formation, including calculating, by a hardware processor and in response to determining that an magnitude of gyro data representing rotations of a drill bit in a bottom hole assembly (BHA) and a time derivative of the gyro data are within a pre-determined range, a drift parameter of the gyro data, analyzing, by the hardware processor, the gyro data based on the drift parameter to generate a stick-slip alert, and presenting the stick-slip alert.

Other aspects of the invention will be apparent from the following detailed description and the appended claims.

BRIEF DESCRIPTION OF DRAWINGS

The appended drawings illustrate several embodiments of detecting stick-slip using a gyro while drilling and are not to be considered limiting of its scope, for detecting stick-slip using a gyro while drilling may admit to other equally effective embodiments.

FIG. 1.1 is a schematic view of a wellsite depicting a drilling operation in which one or more embodiments of detecting stick-slip using a gyro while drilling may be implemented.

FIG. 1.2 shows a system for detecting stick-slip using a gyro while drilling in accordance with one or more embodiments.

FIGS. 2.1 and 2.2 depict an example flowchart of detecting stick-slip using a gyro while drilling in accordance with one or more embodiments.

FIGS. 3.1-4.5 depict an example of detecting stick-slip using a gyro while drilling in accordance with one or more embodiments.

DETAILED DESCRIPTION

Figure 5:
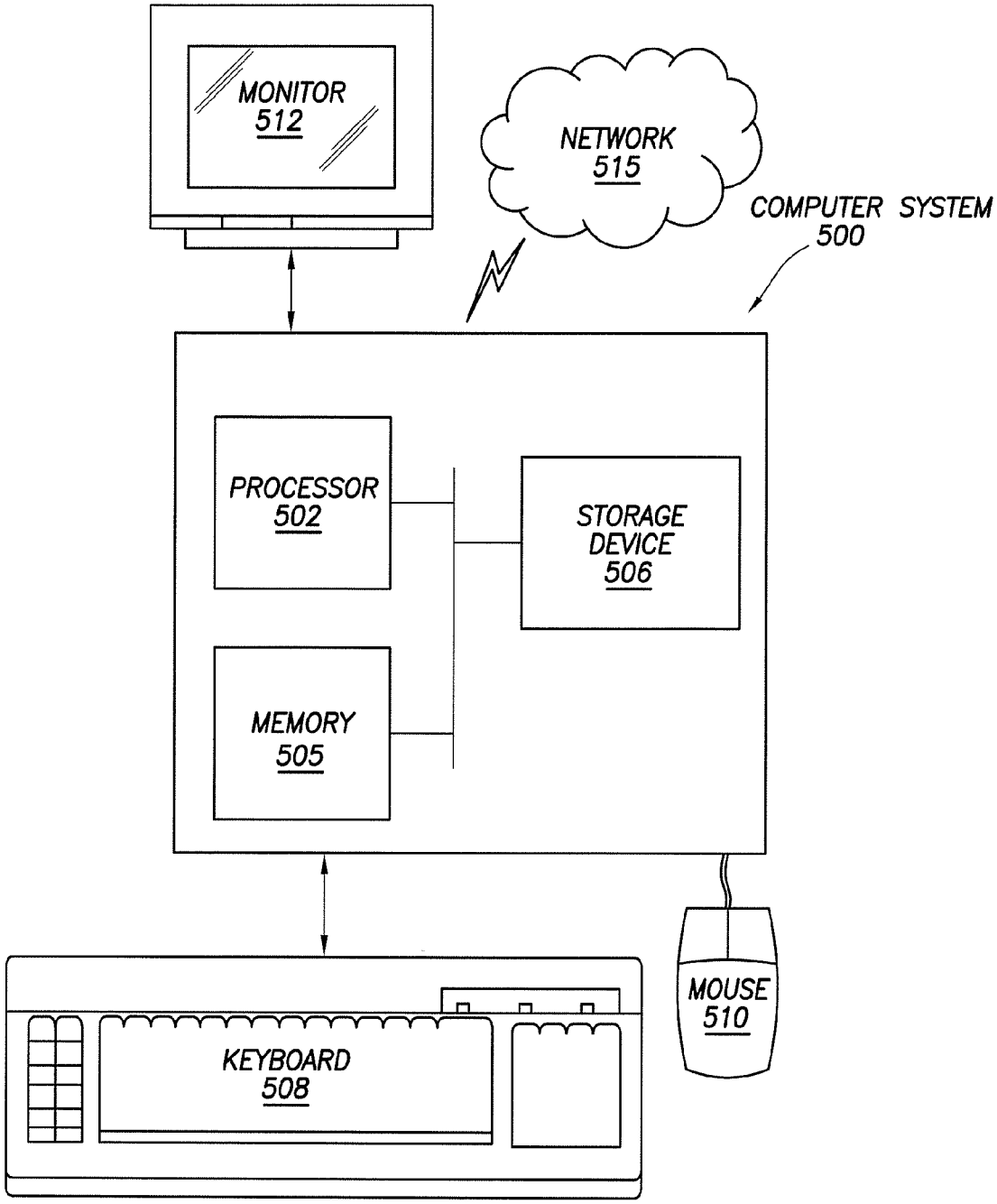
FIG. 5 depicts a computer system using which one or more embodiments of detecting stick-slip using a gyro while drilling may be implemented.

Aspects of the present disclosure are shown in the above-identified drawings and described below. In the description, like or identical reference numerals are used to identify common or similar elements. The drawings are not necessarily to scale and certain features may be shown exaggerated in scale or in schematic in the interest of clarity and conciseness.

Aspects of the present disclosure include a method, system, and computer readable medium to analyze drillstring gyro data for detecting a stick-slip event in the drilling operation. In one or more embodiments, a drift parameter of the gyro data is calculated in response to determining that a magnitude of gyro data and a time derivative of the gyro data are within a pre-determined range. Accordingly, the gyro data is analyzed based on the drift parameter to generate a stick-slip alert. The stick-slip alert includes a stick-slip occurrence alert indicating the existence (i.e., occurrence) of a stick-slip condition and/or a stick-slip precursor alert indicating degenerating conditions (i.e., stick-slip precursor) that precede a stick-slip in the drilling operations. The stick-slip alert may be monitored by and the conditions corrected automatically by a tool, such as bottom hole assembly, or by a user. In one or more embodiments, embodiments of detecting stick-slip using a gyro while drilling allow a user to visualize stick-slip with the benefit of high frequency gyro data. In particular, the stick-slip data is represented by simple indicators to fit within data rate constraints between downhole tools and the surface unit. Throughout this disclosure, the terms "gyro" and "gyro sensor" may be used interchangeably depending on the context.

FIG. 1.1 is a schematic view of a wellsite (100) depicting a drilling operation. The wellsite (100) includes a drilling system (311) and a surface unit (334). In the illustrated embodiment, a borehole (313) is formed by rotary drilling in a manner that is well known. Those of ordinary skill in the art given the benefit of this disclosure will appreciate, however, that detecting stick-slip using a gyro while drilling as disclosed herein may also be used in drilling applications other than conventional rotary drilling (e.g., mud-motor based directional drilling), and is not limited to land-based rigs.

The drilling system (311) includes a drill string (315) suspended within the borehole (313) with a drill bit (310) at its lower end. The drilling system (311) also includes the land-based platform and derrick assembly (312) positioned over the borehole (313) penetrating a subterranean formation (F). The assembly (312) includes a rotary table (314), kelly (316), hook (318) and rotary swivel (319). The drill string (315) is rotated by the rotary table (314), energized by means not shown, which engages the kelly (316) at the upper end of the drill string. The drill string (315) is suspended from hook (318), attached to a traveling block (also not shown), through the kelly (316) and a rotary swivel (319) which permits rotation of the drill string relative to the hook.

The drilling system (311) further includes drilling fluid or mud (320) stored in a pit (322) formed at the well site. A pump (324) delivers the drilling fluid (320) to the interior of the drill string (315) via a port in the swivel (319), inducing the drilling fluid to flow downwardly through the drill string (315) as indicated by the directional arrow. The drilling fluid (320) exits the drill string (315) via ports in the drill bit (310), and then circulates upwardly through the region between the outside of the drill string (315) and the wall of the borehole (313), called the annulus (326). In this manner, the drilling fluid (320) lubricates the drill bit (310) and carries formation cuttings up to the surface as it is returned to the pit (322) for recirculation.

The drill string (315) further includes a bottom hole assembly (BHA) (330), near the drill bit (310). In other words, the BHA may be located within several drill collar lengths from the drill bit. The BHA (330) includes capabilities for measuring, processing, and storing information, as well as communicating with the surface unit. The BHA (330) further includes drill collars (328) for performing various other measurement functions. In one or more embodiments, the BHA (330) includes the stick-slip detector (200).

Sensors (S) are located about the wellsite to collect data, which may be in real time, concerning the operation of the wellsite, as well as conditions at the wellsite. The sensors (S) may also have features or capabilities, of monitors, such as cameras (not shown), to provide pictures of the operation. Surface sensors or gauges (S) may be deployed about the surface systems to provide information about the surface unit, such as standpipe pressure, hook load, depth, surface torque, rotary rotations per minute (rpm), among others. Downhole sensors or gauges (S) are disposed about the drilling tool and/or wellbore to provide information about downhole conditions, such as wellbore pressure, weight on bit, torque on bit, direction, inclination, collar rpm, tool temperature, annular temperature and toolface, among others. Multiple downhole sensors (S) may be located at different positions on BHA (330), such as sensor (201) and sensor (202). In one or more embodiments, sensor (201) and sensor (202) may include one or more magnetometers and gyro sensors. In one or more embodiments, a magnetometer is a device for measuring the intensity of a magnetic field. In one or more embodiments, a gyro sensor is a device for measuring angular velocity. Once drilling stops and the collar stops rotating, a magnetometer may be use to detect a zero collar rpm because magnetometer rpm is derived from alternating current (AC) data. On the other hand, gyro data, or output from a gyro sensor, may drift with temperature and other environmental conditions, which makes detecting the zero rpm more challenging. In one or more embodiments, the gyro data is analyzed to eliminate and/or reduce the effects of the drift, and as a result, obtain a reliable and accurate rpm of the drill string for stick-slip detection. The information collected by the sensors and cameras is conveyed to the various parts of the drilling system and/or the surface unit (334).

The BHA (330) and/or surface unit (334) may include all or a portion of a stick-slip detector (shown in FIG. 1.2). For example, the stick-slip detector (200) may be located on the BHA (330), on the surface unit (334), or a portion may be located on the BHA (330) and another portion may be located on the surface unit (334). Alternatively, all or a portion of the stick-slip detector (200) may be located in a remote location from the oilfield. The stick-slip detector (200) includes functionality to detect stick slip. Further, in one or more embodiments, the stick slip detector (200) may include functionality to adjust physical components of the BHA (330) in response to detecting stick slip. The stick-slip detector (200) is discussed in further detail below with respect to FIG. 1.2.

Continuing with FIG. 1.1, the drilling system (311) is operatively connected to the surface unit (334) for communication therewith. The BHA (330) is provided with a communication subassembly (352) that communicates with the surface unit. The communication subassembly (352) is adapted to send signals to and receive signals from the surface using mud pulse telemetry. The communication subassembly (352) may include, for example, a transmitter that generates a signal, such as an acoustic or electromagnetic signal, which is representative of the measured drilling parameters. It will be appreciated by one of skill in the art that a variety of telemetry systems may be employed, such as mud pulse telemetry, wired drill pipe, electromagnetic or other known telemetry systems.

Typically, the wellbore is drilled according to a drilling plan that is established prior to drilling. The drilling plan typically sets forth equipment, pressures, trajectories and/or other parameters that define the drilling process for the wellsite. The drilling operation may then be performed according to the drilling plan. However, as information is gathered, the drilling operation may deviate from the drilling plan. Additionally, as drilling or other operations are performed, the subsurface conditions may change. The earth model may also be adjusted as new information is collected. Such information may include results generated by the stick-slip detector (200) that are used to identify corrective actions to address a stick-slip event or to determine the rock strength and information of other rock to drill bit interactions. For example, the corrective action may include increasing a torque of the drilling operation and/or reducing a load of the drilling operation. Further, the drilling plan may also be adjusted based on the rock strength and information of other rock to drill bit interactions.

The subterranean assets are not limited to hydrocarbons such as oil, throughout this document, the terms "oilfield" and "oilfield operation" may be used interchangeably with the terms "field" and "field operation" to refer to a site where any type of valuable fluids can be found and the activities for extracting them. The terms may also refer to sites where substances are deposited or stored by injecting them into the surface using boreholes and the operations associated with this process. Further, the term "field operation" refers to a field operation associated with a field, including activities related to field planning, wellbore drilling, wellbore completion, and/or production using the wellbore.

FIG. 1.2 shows more details of the stick-slip detector (200) depicted in FIG. 1.1. As shown in FIG. 1.2, the stick-slip detector (200) includes a gyro data analyzer (202) and a data repository (210) storing various data used or generated by the gyro data analyzer (202). In one or more embodiments, one or more of the modules and elements shown in FIG. 1.2 may be omitted, repeated, and/or substituted. Accordingly, embodiments of detecting stick-slip using a gyro while drilling should not be considered limited to the specific arrangements of modules shown in FIG. 1.2.

In one or more embodiments, the data repository (210) is any type of storage unit and/or device (e.g., a file system, database, collection of tables, or any other storage mechanism) for storing data. Further, the data repository (210) may include multiple different storage units and/or devices. The multiple different storage units and/or devices may or may not be of the same type or located at the same physical site. For example, a portion of the data repository (210) may be located on the BHA (330) while another portion may be located at the surface unit (334).

In one or more embodiments, the stick-slip detector (200) corresponds to hardware, software, or a combination thereof for analyzing drilling operations and detecting stick slip of the drilling operations. In one or more embodiments, the stick-slip detector (200) is configured to receive one or more of gyro data (214) and historical gyro data (215) from the gyro sensor (201), and optionally historical magnetometer data (216) from the magnetometer (203). In particular, the gyro data (214) represents rotations of the drill bit (310) in the BHA (330), shown in FIG. 1.1. In one or more embodiments, the gyro data is collected in real time during the drilling operation depicted in FIG. 1.1. In one or more embodiments, the historical gyro data (215) and historical magnetometer data (216) may be previously (i.e., prior to the current stage of the drilling operation, for example, from drilling an earlier section of the borehole (313)) received from the gyro sensor (201) and the magnetometer (203), and stored in the repository (210). In one or more embodiments, the historical gyro data (215) and historical magnetometer data (216) may be calibration data that are characteristics of the gyro sensor (201) and magnetometer (203). The magnetometer historical data can be obtained on a surface test bench or downhole. In such embodiments, the historical gyro data (215) and historical magnetometer data (216) are stored in the data repository (210) without actively receiving from the gyro sensor (201) and the magnetometer (203).

As noted above, the gyro data gives a deeper insight of the rotational vibrations and covers higher frequency range as compared to the magnetometer data. Drilling introduces high frequency noise to the gyro data even at low rpms. To reliably identify the zero drift in the gyro data, a criterion combining a gyro data threshold with a threshold of its variation (e.g., the derivative), is used to form a logical assessment of the drilling data. In one or more embodiments, the criterion includes the following: (i) the gyro signal should be near zero (e.g., within 20 rpm), and (ii) the data is sufficiently smooth (i.e., the derivative is not noisy).

In one or more embodiments, the stick-slip detector (200) includes the gyro data analyzer (202) that is configured to (i) calculate, in response to determining that a magnitude of the gyro data and a time derivative of the gyro data are within a pre-determined range (e.g., threshold1 and threshold2 shown in TABLE 1), a drift parameter (e.g., the parameter Drift shown in TABLE 1) of the gyro data, (ii) analyze the gyro data based on the drift parameter to generate a stick-slip alert, and (iii) present the stick-slip alert. As noted above, the stick-slip alert may be a stick-slip occurrence alert or a stick-slip precursor alert. In one or more embodiments, analyzing the gyro data of element (ii) includes adjusting the gyro data based on the drift parameter that is calculated at least once during each of a sequence of consecutive time periods, and generating a number of histograms (211) of the gyro data. A histogram is a graphical representation showing a distribution of data. It is an estimate of the probability distribution of a continuous variable whose values are categorized into discrete consecutive intervals (i.e., bins). A histogram consists of tabular frequencies or counts, shown as adjacent rectangles erected over multiple bins, with an area or height equal to the frequency or count of the observations in the interval. In one or more embodiments, each of the gyro data histograms (211) corresponds to one of the consecutive time periods. As noted above, a set of rotational data (e.g., gyro data) satisfying the aforementioned zero conditions (i.e., low variation and within a known threshold) will distinctively accumulate over a single bin in the histogram. In one or more embodiments, the histogram is used as a way of applying the zero detection algorithm.

In one or more embodiments, the elements (i) and (ii) performed by the gyro data analyzer (202) are based on the example algorithm shown in TABLE 1 below. Within the example algorithm, the first if-statement (Line 4) checks to determine whether the drilling collar is below the maximum drift as defined by a first threshold. The second if-statement (Line 5) checks to determine whether the drilling collar is more likely to be at rest as defined by the second threshold. If both statements are true, the drift will be the average of the gyro signal over this period of 'resting' time as defined in Line 6. This is shown in the analogue form as the integral over the time interval divided by change in time.

TABLE 1

| | |
|---|---|
| Line 1: | Start from Drift = 0 |
| Line 2: | $\Delta t$ = 1 second: |

TABLE 1-continued

| | |
|---|---|
| Line 3: | Check Drift Each Second: |
| Line 4: | if abs(Gyro) ≤ threshold1 |
| Line 5: | $\text{if abs}\left[\frac{d\text{Gyro}}{dt}\right] \leq \text{threshold2}$ |
| Line 6: | $\text{Drift} = \frac{\int_t^{t+\Delta t} Gyro\, dt}{\Delta t}$ |
| Line 7: | EndIf |
| Line 8: | EndIf |

In one or more embodiments, the element (iii) performed by the gyro data analyzer (202) includes generating a three dimensional (3D) contour of the gyro data and/or a waterfall representation of the gyro data by combining the gyro data histograms (211), and automatically identifying one or more of a stick phase, a transition phase, and a quick rotation per minute phase based on a shape of the 3D contour and/or a pattern of the waterfall representation. Examples of the gyro data histograms (211), 3D contour plot (212), waterfall representation (213), and automatically identifying the aforementioned phases are described in reference to FIGS. 3.1-4.5 below.

In one or more embodiments, the precursor phase of stick-slip is identified, automatically or manually, such that corrective actions are taken to avoid stick-slip. In one or more embodiments, identifying the stick phase, transition phase, and quick rotation per minute phase is based on user input. In such embodiments, the gyro data analyzer (202) is configured to present the 3D contour PLOT (212) and/or the waterfall representation (213) to a user, and receive an input from the user to identify one or more of the stick phase, the transition phase, and the quick rotation per minute phase.

In one or more embodiments, the pre-determined range threshold1 and threshold2 are determined optionally by using magnetometer data to calibrate the gyro data. In such embodiments, the gyro data analyzer (202) is configured to identify the pre-determined range by comparing historical gyro data (215) of a historical stick-slip event of the BHA (330) and historical magnetometer data (216) of the historical stick-slip event. Additional details of using magnetometer data to calibrate the gyro data and determine the pre-determined range threshold1 and threshold2 are described in reference to FIG. 2.1 below.

In one or more embodiments, a first portion of the gyro data analyzer (202) is located on the BHA (330) and is configured to calculate the drift parameter, and a second portion of the gyro data analyzer (202) is located in the surface unit (334) that is configured to analyze the gyro data. In one or more embodiments, the entire gyro data analyzer (202) is located on the BHA (330). In one or more embodiments, the example algorithm shown in TABLE 1 is performed in real time. Said in other words, the stick-slip alert is generated by the gyro data analyzer (202) within a pre-determined time window (i.e., the computation time of the example algorithm) of obtaining the gyro data. As noted above, the stick-slip alert may be a stick-slip occurrence alert or a stick-slip precursor alert. In one or more embodiments, the stick-slip alert generated by the gyro data analyzer (202) is presented to the BHA to initiate a corrective action to prevent or remove a stick-slip condition of the drilling operation. For example, the corrective action may include increasing a torque of the drilling operation and/or reducing a load of the drilling operation.

FIG. 2.1 depicts an example flowchart of detecting stick-slip using a gyro while drilling in accordance with one or more embodiments. For example, the method depicted in FIG. 2.1 may be practiced using the stick-slip detector (200) described in reference to FIGS. 1.1 and 1.2 above. In one or more embodiments, one or more of the elements shown in FIG. 2.1 may be omitted, repeated, and/or performed in a different order. Accordingly, embodiments of detecting stick-slip using a gyro while drilling should not be considered limited to the specific arrangements of elements shown in FIG. 2.1.

Initially in Block 231, histograms of the gyro data are generated. In particular, the gyro data represents rotations of a drill bit in a bottom hole assembly (BHA) during a drilling operation. In one or more embodiments, the histograms are generated with a selective drift parameter correction. Specifically, in response to determining that a magnitude of gyro data and a time derivative of the gyro data are within a pre-determined range, a drift parameter of the gyro data is calculated. In one or more embodiments, the drift parameter is calculated at least once during each of a sequence of consecutive time periods, where each of the histograms corresponds to one of the consecutive time periods. For example, each gyro data sample (or portion of gyro data) may be offset (i.e., corrected) using the calculated drift parameter to compensate for potential gyro sensor signal drift due to the instrument limitation under the downhole environment, such as excessive temperature, vibrations, etc.

In one or more embodiments, the histograms are generated by the BHA. In one or more embodiments, the histograms are generated at a surface unit based on information provided by the BHA, for example, via the mud telemetry up-link. Additional details of determining the range and calculating the drift parameter are described in reference to FIG. 2.2 below. Example histograms are shown in FIGS. 3.1-4.2 below.

In block 232, a three dimensional (3D) contour (referred to as a 3D contour plot) of the gyro data is generated by combining the sequence of histograms. In one or more embodiments, each histogram is treated as a cross section of the 3D contour such that multiple histograms corresponding to consecutive time periods are stacked one after another in a 3D view. In particular, each pair of adjacent histograms in the 3D stack are placed apart with an appropriate separation. For example, the 40 histograms shown in FIGS. 4.1 and 4.2 are stacked into the 3D contour plot shown in FIG. 4.3. In one or more embodiments, a reduced set of histograms periodically selected from the sequence of histograms are used to construct the 3D contour plot. For example, the number of selected samples may depend on the total number of histograms, such as only even numbers of the sequence of 40 histograms are used. In another example, one out of every 20 histograms may be used out of a total 400 histograms. In one or more embodiments, the 3D contour is generated by the BHA. In one or more embodiments, the 3D contour is generated at a surface unit based on information provided by the BHA, for example via the mud telemetry up-link.

In block 233, a waterfall representation of the gyro data is generated by combining the sequence of histograms. In one or more embodiments, multiple histograms corresponding to consecutive time periods are stacked one after another in a 2D view, referred to as the waterfall representation. Specifically, each histogram is represented by a contour line in the 2D stack. Further, each pair of adjacent histograms in the 2D stack are placed apart with an appropriate and equidistant separation between the endpoints. For example, a portion of the 40 histograms shown in FIGS. 4.1 and 4.2 are stacked into the 2D view as the waterfall representation (441) shown in FIG. 4.4. In one or more embodiments, a reduced set of histograms periodically selected from the sequence of histograms are used to construct the 2D view. For example, the number of selected samples may depend on the total number of histograms, such as only even numbers of the sequence of 40 histograms are used. In another example, one out of every 20 histograms may be used out of a total 400 histograms. In one or more embodiments, the waterfall representation is generated by the BHA. In one or more embodiments, the waterfall representation is generated at a surface unit based on information provided by the BHA, for example via the mud telemetry up-link.

In block 234, a stick-slip alert is generated and presented based on one or more of the histograms, 3D contour plot, and waterfall representation generated above. In one or more embodiments, one or more of a stick phase, a transition phase, and a quick rotation per minute phase are identified based on a shape of the 3D contour plot and/or a pattern of the waterfall representation. Accordingly, the stick-slip alert is generated based on occurrence(s) of the one or more of a stick phase, a transition phase, and a quick rotation per minute phase. In one or more embodiments, identifying these phases and generating the alert are performed automatically by analyzing, using pre-determined pattern recognition algorithms, the gyro data in the format of histograms, 3D contour plot, and/or the waterfall representation.

As noted above, the stick-slip alert may be a stick-slip occurrence alert or a stick-slip precursor alert. As an example, a stick-slip precursor alert can be sent to the user or can trigger automatic corrective action to avoid the development of the stick-slip. In one or more embodiments, the precursor is quantified by one or more pattern reflected in the histogram, such as oscillation of the rpm while drilling that is qualified by standard deviation divided by mean. An example of the pattern recognition algorithm is described in reference to FIG. 4.1 below.

In one or more embodiments, the automatic analysis using the pattern recognition algorithms may be performed by the BHA, a surface unit, or a combination thereof. In one or more embodiments, identifying these phases and generating the alert are performed by a user in response to viewing the histograms, 3D contour plot, and/or the waterfall representation based on expert knowledge. For example, in response to presenting the histograms, 3D contour plot, and/or the waterfall representation to the user, an input may be received from the user to identify the stick phase, the transition phase, and/or the quick rotation per minute phase, as well as to generate an appropriate alert.

In block 235, in response to generating the stick-slip alert, a corrective action is initiated to prevent or remove a stick-slip condition of the drilling operation. For example, the corrective action may be in response to a stick-slip precursor alert for preventing an emerging stick-slip condition. In another example, the corrective action may be in response to a stick-slip occurrence alert for removing an already occurred stick-slip condition. In one or more embodiments, the corrective action may include one or more of increasing a torque of the drilling operation and reducing a load of the drilling operation. In one or more embodiments, the corrective action is automatically initiated by the BHA. In one or more embodiments, the corrective action is initiated (e.g., automatically or by a user) at a surface unit based on information provided by the BHA, for example via the mud telemetry up-link. In one or more embodiments, the stick-slip alert is generated within a pre-determined time window of obtaining the gyro data. In those embodiments of automatically generated stick-slip alert and automatically initiated corrective action, the pre-determined time window is limited by the automated analysis and processing delay such that the alert and the corrective action are generated/initiated in real time.

FIG. 2.2 shows a detailed flow chart of block 231 shown in FIG. 2.1 above. For example, the method depicted in FIG. 2.2 may be practiced using the stick-slip detector (200) described in reference to FIGS. 1.1 and 1.2 above. In one or more embodiments, one or more of the elements shown in FIG. 2.2 may be omitted, repeated, and/or performed in a different order. Accordingly, embodiments of detecting stick-slip using a gyro while drilling should not be considered limited to the specific arrangements of elements shown in FIG. 2.2.

Initially in block (221), gyro data representing rotations of a drill bit is obtained during a drilling operation. For example, the gyro data is obtained in real time from one or more gyro sensors located on a BHA.

In block 222, a determination is made regarding whether the magnitude and a time derivative of the gyro data are within a pre-determined range or not. If the magnitude and/or the time derivative is not within a pre-determined range, the drill bit is considered to be rotating normally and block (223) is skipped. If the answer is yes, the method proceeds to block (223) where a new drift parameter is calculated based on the gyro data. In one or more embodiments, the drift parameter is calculated using the skip-slip detector (200) described in reference to FIGS. 1.1 and 1.2 above. For example, the calculation may be based on the algorithm illustrated in TABLE 1 above.

In block 224, a determination is made whether the threshold validation phase is activated. If the threshold validation phase is activated, the method proceeds to block 226 where the drift parameter can be optionally validated by comparing to magnetometer data. For example, a drift amount determined using the magnetometer data is considered accurate and used to calibrate the drift parameter calculated from the gyro data. If the validation result of block 226 is positive, the gyro data calculated drift parameter is considered valid. In this case, the method returns to block 221 to continue calibrating the thresholds used in calculating the drift parameter until the threshold validation phase ends. If the validation result of block 226 is negative, the gyro data calculated drift parameter is considered invalid due to, inadequate pre-determined range value (e.g., threshold1 and threshold2 of TABLE 1) used in calculating the drift parameter. In this case, the method proceeds to block 227 where the pre-determined range is adjusted. Subsequently, the method returns to block 221 to continue calibrating the drift parameter using the adjusted thresholds until the threshold validation phase ends. In one or more embodiments, the threshold validation phase is activated (i.e., started) and de-activated (i.e., ended) based on user command. In one or more embodiments, the threshold validation phase is activated (i.e., started) and de-activated (i.e., ended) automatically, for example on a pre-determined recurring schedule or based on an event trigger.

When the threshold validation phase is not activated, i.e., the answer to block 224 is no, the method proceeds to block 225, where the gyro data is adjusted based on either a previously calculated drift parameter or the newly calculated drift parameter from block 223. In one or more embodiments, adjusting the gyro data may include deducting the amount of the drift parameter as an offset from the value of the gyro data. For example, this adjusts gyro sensor signal output drift induced by severe downhole environment, such as excessive temperature, shock, and/or vibrations.

In block 228, a determination is made whether to continue collecting and drift-adjusting the gyro data for the current time period. If the determination is made to continue collecting, the method returns to block 221 to gather additional gyro data samples for the current time period. If the determination is made to stop collecting and, thereby, end the current time period, the method proceeds to block 229, where a histogram is generated for the current time period using the gyro data collected and drift-adjusted during the current time period. This histogram is added to the sequence of histograms generated in block 231 of FIG. 2.1.

The method proceeds to block 230 where it is determined whether there is another time period to analyze. If another time period is to be analyzed, the method returns to block 221 to start collecting gyro data for the next time period. Otherwise, the method ends in one or more embodiments.

FIGS. 3.1-4.5 depict an example of detecting stick-slip using a gyro while drilling in accordance with one or more embodiments. For example, the example depicted in FIGS. 3.1-4.5 may be practiced using the stick-slip detector (200) described in reference to FIGS. 1.1 and 1.2 as well as practiced using the method described in reference to FIGS. 2.1 and 2.2. As shown in FIGS. 3.1-4.5, the gyro data is represented using a histogram. This simple but different way of presenting the gyro data, reveals the drilling properties clearly. The histogram shows basic drilling properties, such as the rotations per minute (rpm). In one or more embodiments, gyro data collected within a window of time is aggregated into one histogram having a number of bins. This data organization conserves memory usage to represent a large volume of gyro data.

FIG. 3.1 shows gyro data in histogram format from a normal drilling operation. Each histogram (e.g., the histogram (360)) has a number of bins (e.g., the bin (364)) that substantially fit a normal distribution. The average rpm (approximately 95 rpm) is shown as a center line segment (e.g., the line segment (363)) in the histogram (e.g., the histogram (360)). Each histogram represents 100 seconds of 1024 Hz gyro data, i.e., 102,400 gyro data samples. There are total 10 histograms shown in FIG. 3.1, representing 10 consecutive 100 seconds time window of gyro data. The two boxes on each histogram denoted, 2SIGMA and STD/MEAN, show the percentage of gyro data samples within two standard deviations (i.e., $\pm 2\sigma$) from the mean and the ratio between the standard deviation (i.e., $\sigma$) and the mean, respectively.

The sidelines (e.g., sidelines (362) on the histogram (360)) are placed at two standard deviations from the mean. For a normal distribution, approximately 95% of the data samples should fall within the two sidelines (e.g., sidelines (362) on the histogram (360)). These 10 histograms show that as the oscillation (i.e., of BHA and/or drillstring) increases the normal distribution of the gyro data histograms is well preserved while the ratio STD/MEAN can vary widely. This effect will be shown in later figures to be a precursor of stick-slip initiation and is used to help avoiding going into stick-slip in the first place, rather than detecting it after occurrence. The histograms in FIG. 1.1 shift slightly due to drift in the gyro sensor. This is not crucial to observe normal drilling trends. When the drillstring comes to a complete rest, the gyro drift becomes more problematic. zero rpm detection is used to determine whether the collar is not rotating or to detect the stick phase during stick-slip events and other important drilling events.

FIG. 3.2 shows the gyro data histograms during a stick-slip event. There are total 10 histograms shown in FIG. 3.2, representing 10 consecutive 100 seconds time window of gyro data centering around −10 rpm instead of 0 due to the drift in the gyro sensor. This drift (370) (i.e., offset between 0 and the peak of a histogram) is not constant and can change during the run, but may change relatively slowly. To correct this drift (370) without detecting false zeros, a characterization of the drift error is performed. The first aspect is the absolute value of the gyro drift. This information can be obtained from manufacturer's data. For example, the manufacturer specified gyro drift in the example shown in FIG. 3.2 is limited to ±20 rpm. This means under no condition the 'zero' drift can fall out of this range according to the manufacturers specifications. A fixed threshold that considers any gyro data within this range (e.g., ±20 rpm) to represent zero rpm may lead to inaccurate conclusions. In an example scenario where the gyro sensor drift is −20 rpm and the collar actually rotates at 40 rpm, the threshold will force the apparent rpm reading to 0, which is inaccurate.

The idea is to confirm the zero collar rpm by considering the noise, standard deviation, or derivative of the signal. If the change or variance is below a certain level, then the collar is highly unlikely to be moving. When using the noise approach alone, the rpm becomes very stable during very smooth drilling that the noise or bandwidth drops to a 'grey area' that can be confused with a stationary collar. On the other hand, drilling at low rpm (e.g., less than 40 rpm) does not exhibit any stability. Therefore combining both rpm threshold with noise threshold filters the zero rpm from drilling data. Once this zero is found, the gyro data histogram is adjusted (i.e., shifted) and used until new zero detections appear. The data can be LP (low pass) filtered to ensure smooth drift corrections.

FIGS. 4.1-4.5 show the gyro data histograms that are adjusted based on the drift parameter correction described above. These gyro data histograms exhibit distinct shapes for the stick-slip rpm distribution, which can be categorized into three phases:

Stick Phase

The Stick Phase is the part of the histogram surrounding zero. It is a sharp 'spike' because the collar will stay at rest consistently for a period of time, without any motion. It also shows that once the collar starts to move, it does not stay at low speeds for long. Inversely, when the collar is slowing down to a stick phase, it 'breaks' rapidly and settles at zero. The distribution resembles a skewed distribution, such as a Poisson or chi distribution.

Transition Phase: This is the phase when the drill string changes from stick phase to quick rpm phase, or visa versa. This should not be confused with transition from normal drilling to stick-slip state, which is referred to as transition state.

This phase can be divided into 2 sub-parts, accelerating (slip) and decelerating (slow). In the transition phase, the collar appears to swap the velocity range with a uniform distribution. This is a distinct feature of the stick-slip, because the 'height' of the uniform distribution reflects how fast the collar is wandering between the stick phase and quick rpm phase. It can be linked to the compliance of the mechanical system and the stored energy in the stick phase.

Quick RPM Phase

This phase resembles a 'mini-high-speed-drilling' phase, where the collar rotates at a very high rpm to catch up with the surface rotation. The collar appears to quasi-stabilize at the quick rpm phase and it even exhibits a mini normal-distribution around the mean of the quick rpm, in a similar manner as what normal drilling does. The more even the distribution of the quick rpm phase, the more erratic the stick-slip becomes. This is mainly due to a sub-stick-slip phenomenon where the collar sticks and slips several time before going into the stick phase. A similar behavior appears when the collar is released from the stick phase.

The quick rpm phase can be treated as a small normal drilling phase that did not get enough 'support' from the surface torque to continue drilling. As a result, the quick rpm phase fails to sustain itself at this high rpm and high torque, and therefore is forced into a sudden stop, during which the potential energy is stored in the collar and triggers the same cycle again.

While FIGS. 3.1 and 3.2 shown above clearly demonstrate the difference between normal drilling and stick-slip, FIGS. 4.1 and 4.2 show 40 histograms, of groups (411)-(414), during a transition (i.e., transition state) from normal drilling to stick-slip. Each of the 40 histograms is of the same format as those shown in FIGS. 3.1 and 3.2. It can be seen in FIGS. 4.1 and 4.2 that the normal distribution of the gyro data histogram is preserved even when the standard deviation increases. The 2SIGMA deviation changes from 95% to 100% when stick-slip is fully developed, as shown in the histogram groups (412)-(414). Although this change can be used as an indicator for the stick-slip, a better observation of the data distribution shows that using the first bin (415) (which is the same bin used to eliminate and/or reduce the zero drift) is a much better representation of the stick-time and eventually of the stick-slip attributes, such as the period. The standard deviation ratio STD/MEAN can be used as a warning flag as described below.

As noted above, the precursor to stick-slip may be quantified by the oscillation of the rpm while drilling, as reflected by the histogram and qualified by standard deviation divided by mean (e.g., values of STD/MEAN>20% generally occur before fully developed stick-slip phase). More specifically, stick happens when the rpm is zero. During normal drilling, rpm values should be close to MEAN instead of near zero. In particular, approximately 95% of the rpm values are between MEAN-2SIGMA and MEAN+2SIGMA. Similarly, approximately 99.7% of the rpm values are between RPM-3SIGMA and RPM+3SIGMA. The precursor is based on how close is the rpm distribution to zero. For example: if SIGMA is 10 and MEAN is 100, then MEAN-3SIGMA=100−3*10=70, therefore 99.7% of the rpm values are above 70 and below 130, or 99.85% of the rpm values are above 70, therefore, BHA is not in risk of stick-slip initiation. In another example: if SIGMA is 30 and MEAN is 100, then MEAN-3SIGMA=100−3*10=10, therefore 99.7% of the rpm values are above 10 and below 190, or 99.85% of the rpm values are above 10. Although the BHA is still in normal drilling and stick time is still zero, the BHA is considered to be in risk of stick-slip initiation.

For example, Quick rpm value can be generated by applying a pattern recognition technique to the histograms in FIGS. 4.1 and 4.2. In particular, the pattern recognition technique includes:

(i) Calculate the mean (ii) Find the peaks on the histogram (e.g., using a mean/3 window)

(iii) Sort the peaks in descending order (iv) Identify zero RPM peak (from stick-slip detector) and remove it from the sorted list (v) Identify the two highest peaks in the list (vi) Out of the two peaks above, find the peak that is furthest to the mean and label this as quick RPM FIG. 4.3 shows contours of the same 40 histograms of FIGS. 4.1 and 4.2 in a 3D contour plot. This shows the stick-slip where a double peak contour is formed consisting of the stick phase (432), the transition phase (435), and the quick RPM phase (433). In addition, the normal drilling (430), the stick-slip precursor (434), and the transition state (431) can also be seen leading to the double peak contour of stick-slip.

FIGS. 4.4 and 4.5 show how the same 40 histograms of FIGS. 4.1 and 4.2 in a waterfall pattern. This may be compiled at a surface unit with downhole data transmitted up using high data rate uplink such as wired drill pipe. As shown in FIG. 4.4, the first track on the left is the waterfall plot (441). The middle track shows the gyro stick-time (443) and gyro stick-time percentage (442) using the algorithm described previously. The middle track also shows the on/off stick-slip indicator (445) as an alternating solid block pattern where dark block denotes stick-slip on and light block denotes stick-slip off.

As can be seen, the 1024 Hz of stick-slip data is reduced to 40 contours in the waterfall plot (441), and then the 40 contours are reduced to 40 points in the gyro stick-time (442) or stick-time percentage (443). Therefore, the stick-slip detection can be presented accurately with 1 point/100 secs for this example. The track on the right shows a zoom-out view of the data across the dash (444) on the middle track, showing the amount of gyro data used to get the final result.

FIG. 4.5 shows how the different phases are easily distinguished on a waterfall plot. As shown in FIG. 4.5, the normal drilling (430), transition state (431), stick phase (432), transition phase (435), and quick rpm phase (433) shown in FIG. 4.3 are identified to superimpose the waterfall plot (441) shown in FIG. 4.4. By applying additional surface or downhole analysis in conjunction with the waterfall plot (441), the stick-time distribution can be resolved to reveal the average stick-slip period, and the quick rpm phase can be analyzed to identify corrective actions to address the stick-slip event or to determine the rock strength and information of other rock to drill bit interactions. For example, the drilling plan may be adjusted based on the rock strength and information of other rock to drill bit interactions.

As shown by the examples, embodiments of detecting stick-slip using a gyro while drilling allow a user to visualize stick-slip using high frequency gyro data, where the stick-slip data is represented by simple indicators to fit within the slow mud telemetry rates.

Further, those skilled in the art, with the benefit of this disclosure will recognize that the visualization methods described in FIGS. 3.1-4.5 above can also be applied to rpm obtained from magnetometer data. In particular, the zero detection algorithm may be skipped.

Embodiments of detecting stick-slip using a gyro while drilling may be implemented on virtually any type of computer regardless of the platform being used. For instance, as shown in FIG. 5, a computer system (500) includes one or more processor(s) (502) such as a central processing unit (CPU) or other hardware processor, associated memory (505) (e.g., random access memory (RAM), cache memory, flash memory, etc.), a storage device (506) (e.g., a hard disk, an optical drive such as a compact disk drive or digital video disk (DVD) drive, a flash memory stick, etc.), and numerous other elements and functionalities typical of today's computers (not shown). The computer (500) may also include input means, such as a keyboard (508), a mouse (510), or a microphone (not shown). Further, the computer (500) may include output means, such as a monitor (512) (e.g., a liquid crystal display LCD, a plasma display, or cathode ray tube (CRT) monitor). The computer system (500) may be connected to a network (515) (e.g., a local area network (LAN), a wide area network (WAN) such as the Internet, or any other similar type of network) via a network interface connection (not shown). Those skilled in the art will appreciate that many different types of computer systems exist (e.g., workstation, desktop computer, a laptop computer, a personal media device, a mobile device, such as a cell phone or personal digital assistant, or any other computing system capable of executing computer readable instructions), and the aforementioned input and output means may take other forms, now known or later developed. Generally speaking, the computer system (500) includes at least the minimal processing, input, and/or output means necessary to practice one or more embodiments.

Further, those skilled in the art will appreciate that one or more elements of the aforementioned computer system (500) may be located at a remote location and connected to the other elements over a network. Further, one or more embodiments may be implemented on a distributed system having a plurality of nodes, where each portion of the implementation may be located on a different node within the distributed system. In one or more embodiments, the node corresponds to a computer system. Alternatively, the node may correspond to a processor with associated physical memory. The node may alternatively correspond to a processor with shared memory and/or resources. Further, software instructions to perform one or more embodiments may be stored on a computer readable medium such as a compact disc (CD), a diskette, a tape, or any other computer readable storage device.

While detecting stick-slip using a gyro while drilling has been described with respect to a limited number of embodiments, those skilled in the art, having benefit of this disclosure, will appreciate that other embodiments may be devised which do not depart from the scope of detecting stick-slip using a gyro while drilling as disclosed herein. Accordingly, the scope of detecting stick-slip using a gyro while drilling should be limited only by the attached claims.

What is claimed is:

1. A method for drilling operation in a subterranean formation, comprising:

calculating, by a hardware processor and in response to determining that an magnitude of gyro data representing rotations of a drill bit in a bottom hole assembly (BHA) and a time derivative of the gyro data are within a predetermined range, a drift parameter of the gyro data;

analyzing, by the hardware processor, the gyro data based on the drift parameter to generate a stick-slip alert; and presenting the stick-slip alert.

2. The method of claim 1, wherein analyzing the gyro data comprises:

adjusting the gyro data based on the drift parameter that is calculated at least once during each of a plurality of consecutive time periods; and generating a plurality of histograms of the gyro data, wherein at least one of the plurality of histograms corresponds to at least one of the plurality of consecutive time periods.

3. The method of claim 2, wherein analyzing the gyro data further comprises:

generating a three dimensional (3D) contour of the gyro data by combining the plurality of histograms; and identifying at least one selected from a group consisting of a stick phase, a transition phase, and a quick rotation per minute phase based on a shape of the 3D contour.

4. The method of claim 3, further comprising:

presenting the 3D contour to a user; and receiving an input from the user to identify the at least one selected from a group consisting of the stick phase, the transition phase, and the quick rotation per minute phase.

5. The method of claim 2, wherein analyzing the gyro data further comprises:

generating a waterfall representation of the gyro data by combining the plurality of histograms; and identifying at least one selected from a group consisting of a stick phase, a transition phase, and a quick rotation per minute phase based on a pattern of the waterfall representation.

6. The method of claim 5, further comprising:

presenting the waterfall representation to a user; and receiving an input from the user to identify the at least one selected from a group consisting of the stick phase, the transition phase, and the quick rotation per minute phase.

7. The method of claim 1, further comprising:

identifying the pre-determined range by comparing historical gyro data of a historical stick-slip event of the BHA and historical magnetometer data of the historical stick-slip event.

8. The method of claim 1, further comprising:

obtaining the gyro data from a gyro sensor of the BHA; and initiating, in response to generating the stick-slip alert, a corrective action for at least one selected from a group consisting of preventing and removing a stick-slip condition of the drilling operation, wherein the stick-slip alert comprises at least one selected from a group consisting of a stick-slip precursor alert and a stick-slip occurrence alert, wherein the stick-slip alert is generated within a pre-determined time window of obtaining the gyro data, and wherein the corrective action comprises at least one selected from a group consisting of increasing a torque of the drilling operation and reducing a load of the drilling operation.

9. A stick-slip detector for drilling operation in a subterranean formation, comprising:

a processor;

a repository configured to store gyro data representing rotations of a drill bit in a bottom hole assembly (BHA); and a gyro data analyzer executing on the processor and configured to:

calculate, in response to determining that an magnitude of the gyro data and a time derivative of the gyro data are within a pre-determined range, a drift parameter of the gyro data;

analyze the gyro data based on the drift parameter to generate a stick-slip alert; and present the stick-slip alert.

10. The stick-slip detector of claim 9, wherein analyzing the gyro data comprises:

adjusting the gyro data based on the drift parameter that is calculated at least once during each of a plurality of consecutive time periods; and generating a plurality of histograms of the gyro data, wherein at least one of the plurality of histograms corresponds to at least one of the plurality of consecutive time periods.

11. The stick-slip detector of claim 10, wherein analyzing the gyro data further comprises:

generating at least one selected from a group consisting of a three dimensional (3D) contour of the gyro data and a waterfall representation of the gyro data by combining the plurality of histograms; and identifying at least one selected from a group consisting of a stick phase, a transition phase, and a quick rotation per minute phase based on at least one selected from a group consisting of a shape of the 3D contour and a pattern of the waterfall representation.

12. The stick-slip detector of claim 11, wherein the gyro data analyzer is further configured to:

present the at least one selected from a group consisting of the 3D contour and the waterfall representation to a user; and receive an input from the user to identify the at least one selected from a group consisting of the stick phase, the transition phase, and the quick rotation per minute phase.

13. The stick-slip detector of claim 9, wherein the gyro data analyzer is further configured to:

identify the pre-determined range by comparing historical gyro data of a historical stick-slip event of the BHA and historical magnetometer data of the historical stick-slip event.

14. The stick-slip detector of claim 9, wherein the processor comprises:

a first portion located on the BHA and configured to calculate the drift parameter; and a second portion located in a surface unit and configured to analyze the gyro data.

15. The stick-slip detector of claim 9, wherein the processor and the gyro data analyzer are located on the BHA.

16. The stick-slip detector of claim 9, further comprising:

a gyro sensor located on the BHA and configured to obtain the gyro data, wherein the stick-slip alert is generated within a pre-determined time window of obtaining the gyro data, wherein the stick-slip alert comprises at least one selected from a group consisting of a stick-slip precursor alert and a stick-slip occurrence alert, wherein the stick-slip alert is presented to the BHA to initiate a corrective action for at least one selected from a group consisting of preventing and removing a stick-slip condition of the drilling operation, and wherein the corrective action comprises at least one selected from a group consisting of increasing a torque of the drilling operation and reducing a load of the drilling operation.

17. A non-transitory computer readable medium storing instructions for drilling operation in a subterranean formation, the instructions when executed causing a processor to:

calculate, in response to determining that an magnitude of gyro data representing rotations of a drill bit in a bottom hole assembly (BHA) and a time derivative of the gyro data are within a pre-determined range, a drift parameter of the gyro data;

analyze the gyro data based on the drift parameter to generate a stick-slip alert; and present the stick-slip alert.

18. The non-transitory computer readable medium of claim 17, wherein analyzing the gyro data comprises:

adjusting the gyro data based on the drift parameter that is calculated at least once during each of a plurality of consecutive time periods; and generating a plurality of histograms of the gyro data, wherein at least one of the plurality of histograms corresponds to at least one of the plurality of consecutive time periods.

19. The non-transitory computer readable medium of claim 17, wherein analyzing the gyro data further comprises:

generating at least one selected from a group consisting of a three dimensional (3D) contour of the gyro data and a waterfall representation of the gyro data by combining the plurality of histograms; and identifying at least one selected from a group consisting of a stick phase, a transition phase, and a quick rotation per minute phase based on at least one selected from a group consisting of a shape of the 3D contour and a pattern of the waterfall representation.

20. The non-transitory computer readable medium of claim 17, wherein the instructions, when executed, further cause the processor to:

identify the pre-determined range by comparing historical gyro data of a historical stick-slip event of the BHA and historical magnetometer data of the historical stick-slip event.

* * * * *